US006357697B1

(12) United States Patent
Wu

(10) Patent No.: US 6,357,697 B1
(45) Date of Patent: Mar. 19, 2002

(54) KITE STRUCTURE

(76) Inventor: Pao-Chang Wu, 3F, 22, Lane 40, 2nd Bao An Street, Su Lin City, Taipei Hsien (TW)

( * ) Notice: Subject to any disclaimer, the term of this patent is extended or adjusted under 35 U.S.C. 154(b) by 0 days.

(21) Appl. No.: 09/686,568

(22) Filed: Oct. 11, 2000

(51) Int. Cl.[7] ..... B64C 31/06
(52) U.S. Cl. ..... 244/153 R
(58) Field of Search ..... 244/153 R, 154, 244/900, 901

(56) References Cited

U.S. PATENT DOCUMENTS

| | | | | | |
|---|---|---|---|---|---|
| 72,855 | A | * | 12/1867 | Hughes | 244/153 R |
| 2,751,172 | A | * | 6/1956 | Rogallo et al. | 244/153 R |
| 2,762,590 | A | * | 9/1956 | Huie | 244/153 R |
| 4,530,477 | A | * | 7/1985 | Ito et al. | 244/153 R |
| 4,634,085 | A | * | 1/1987 | Cuesta et al. | 244/153 R |

* cited by examiner

*Primary Examiner*—Peter M. Poon
*Assistant Examiner*—Timothy D. Collins
(74) *Attorney, Agent, or Firm*—Alan Kamrath; Rider, Bennett, Egan & Arundel, LLP

(57) ABSTRACT

A kite structure includes a body, and a skeleton. The body has an upper piece and a lower piece stitched on the upper piece in a locally overlapping manner. Each of the upper piece and the lower piece has a central portion provided with a positioning base and a plurality of retaining rings. Each of the upper piece and the lower piece has a front edge provided with curved tubular collars. The skeleton includes a central main bar extending through the retaining rings and having two ends each secured in the positioning base, a manifold connector secured on the central main bar, a left support bar extending through a first one of the curved tubular collars of the upper piece and having a distal end secured in a first side of the manifold connector, a right support bar extending through a second one of the curved tubular collars of the upper piece and having a distal end secured in a second side of the manifold connector, and a lower support bar extending through the curved tubular collar of the lower piece and secured therein.

5 Claims, 6 Drawing Sheets

KITE STRUCTURE

BACKGROUND OF THE INVENTION

1. Field of the Invention

The present invention relates to a kite structure.

2. Description of the Related Art

A conventional kite in accordance with the prior art shown in FIG. 1 includes a body 1, and a cruciform skeleton 2 secured on the body 1. However, such a kite has a fixed shape and pattern without variation, thereby decreasing the aesthetic quality of the kite, and thereby decreasing the purchasing desire of the consumers.

Another type of conventional kite in accordance with the prior art shown in FIG. 2 includes a body 1, a skeleton 2 secured on the body 1, and a plurality of tail straps 3 attached to the body 1. However, the force acted on the kite by the wind power during flight is not exerted on the center point of the kite so that the wind force is not evenly exerted on the kite, thereby easily causing the kite stalling and falling during flight.

SUMMARY OF THE INVENTION

The present invention has arisen to mitigate and/or obviate the disadvantage of the conventional kites.

In accordance with one aspect of the present invention, there is provided a kite structure comprising:

a body including an upper piece and a lower piece stitched on the upper piece in a locally overlapping manner, each of the upper piece and the lower piece having a central portion provided with a positioning base and a plurality of retaining rings, each of the upper piece and the lower piece having a front edge provided with curved tubular collars; and a skeleton including:

a central main bar extending through the retaining rings and having two ends each secured in the positioning base;

a manifold connector secured on the central main bar;

a left support bar extending through a first one of the curved tubular collars of the upper piece and having a distal end secured in a first side of the manifold connector;

a right support bar extending through a second one of the curved tubular collars of the upper piece and having a distal end secured in a second side of the manifold connector; and a lower support bar extending through the curved tubular collar of the lower piece and secured therein.

The curved tubular collars of the upper piece of the body are separated from each other in a symmetrical manner, and the curved tubular collar of the lower piece of the body has a center defining a breach for facilitating insertion of the lower support bar of the skeleton. Each of the upper piece and the lower piece has a rear edge which is flexible without support so that each of the upper piece and the lower piece has a solid front edge which contains the skeleton therein, and a soft rear edge without the skeleton. Preferably, the body consisting of the upper piece and the lower piece has the shape of an animal, an insect or the like.

An objective of the present invention is to provide a kite structure which includes a two-piece shaped body, thereby enhancing the active aesthetic quality of the kite structure, and thereby increasing the balance effect of the kite structure.

Another objective of the present invention is to provide a kite structure which includes a detachable skeleton so that the kite structure is portable and convenient for storage.

Further benefits and advantages of the present invention will become apparent after a careful reading of the detailed description with appropriate reference to the accompanying drawings.

DETAILED DESCRIPTION OF THE INVENTION

Figure 1:
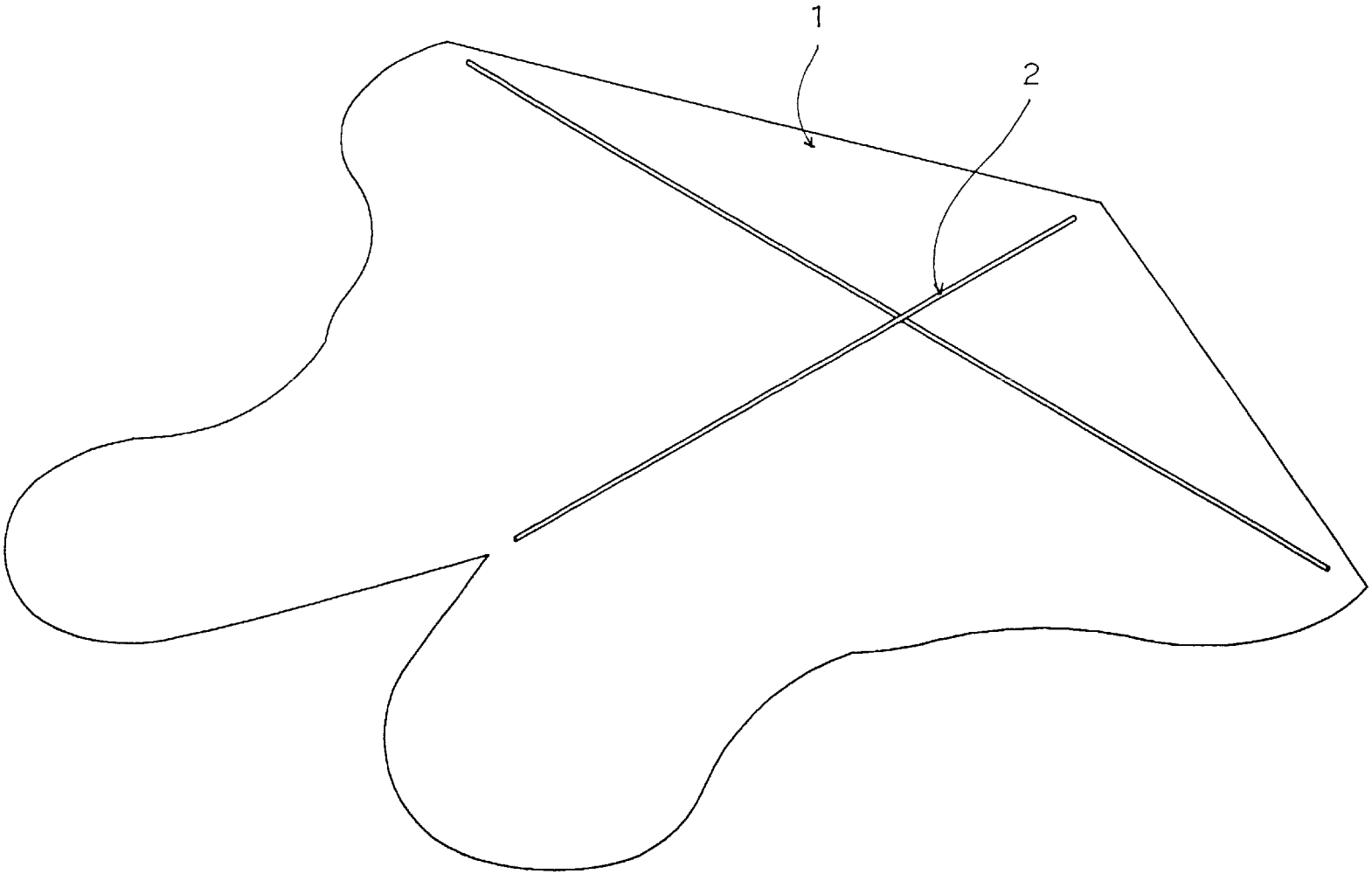
FIG. 1 PRIOR ART
FIG. 1 is a perspective view of a conventional kite in accordance with the prior art.
Figure 2:
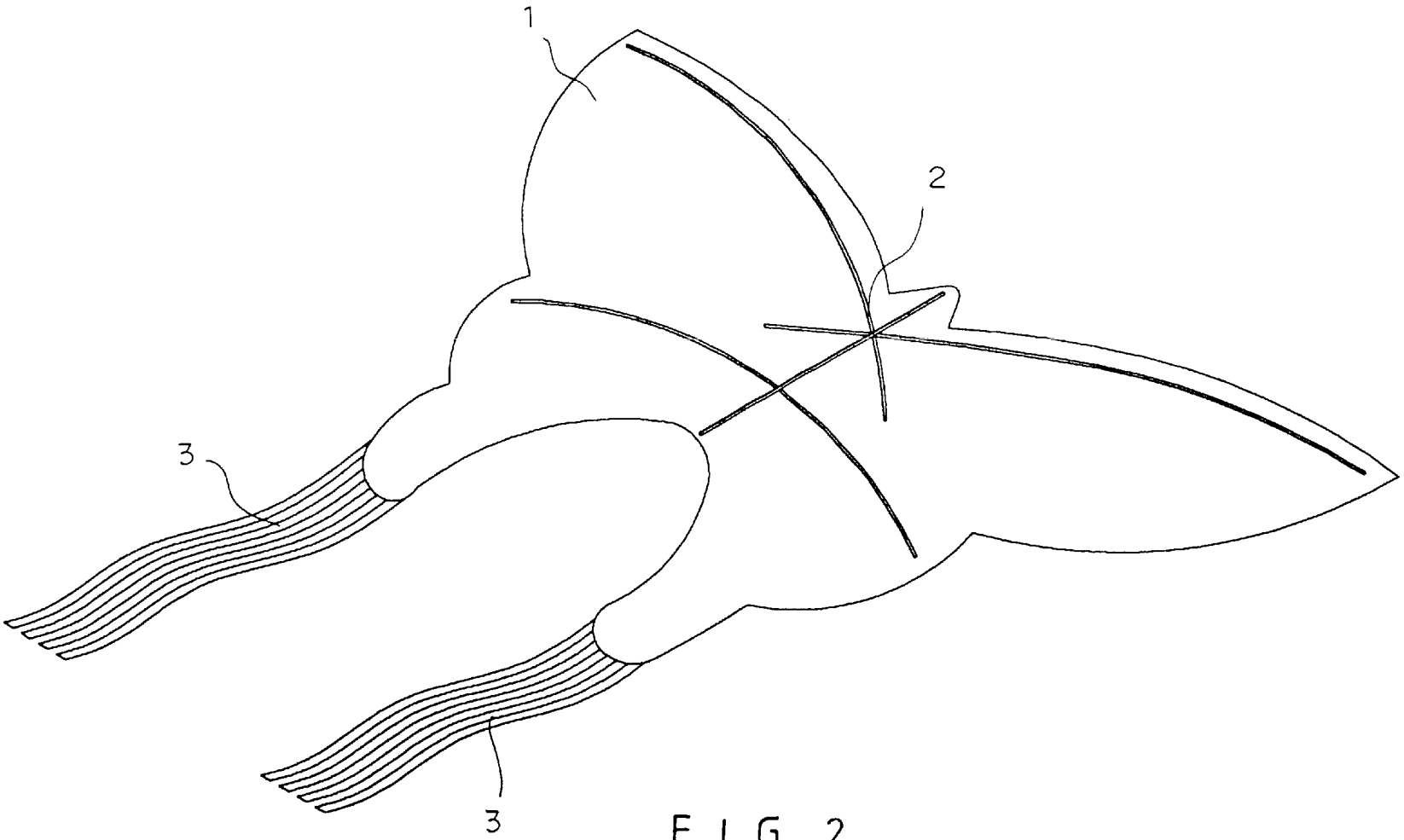
FIG. 2 PRIOR ART
FIG. 2 is a perspective view of another type of conventional kite in accordance with the prior art.
Figure 3:
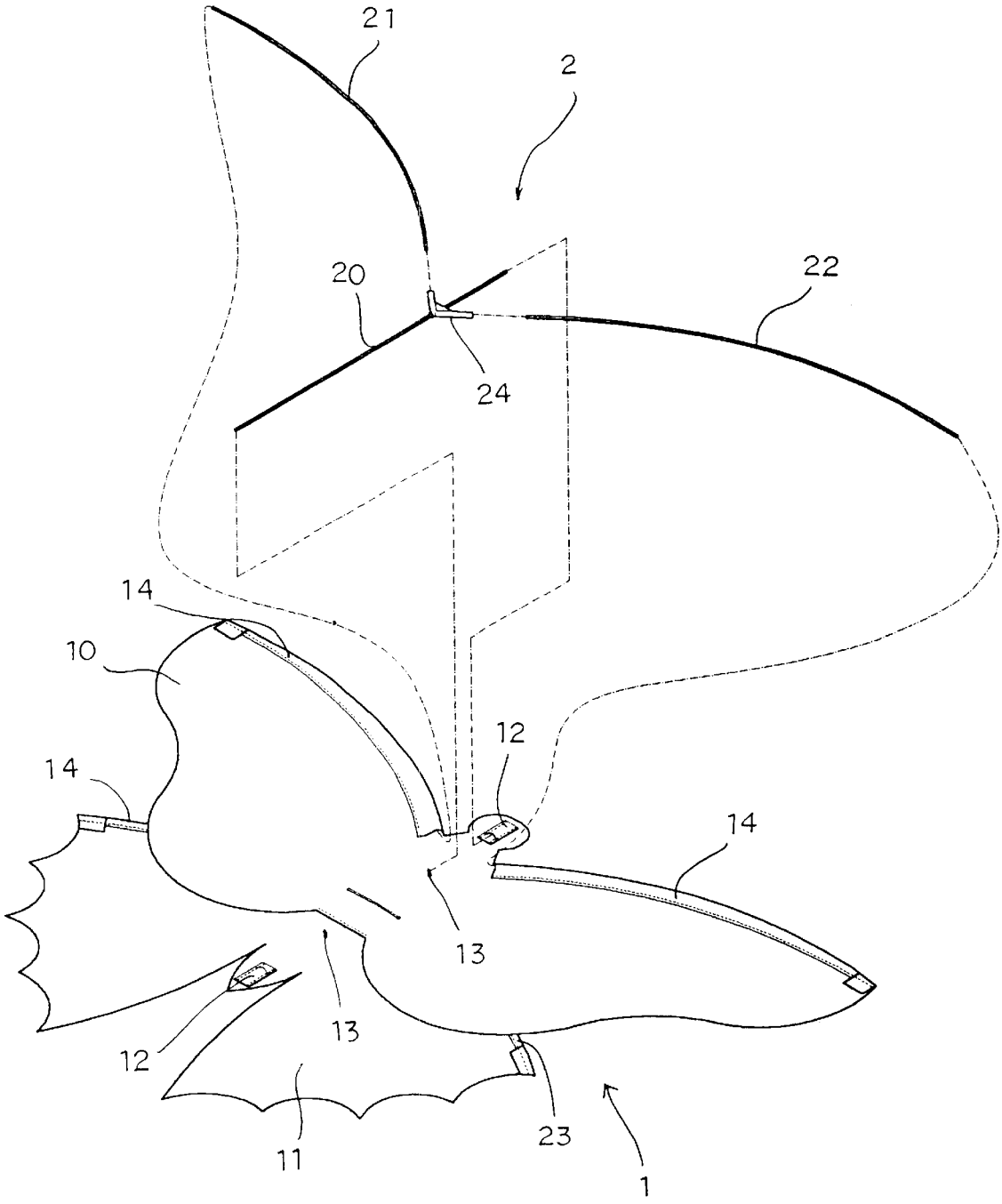
FIG. 3 is an exploded view of a kite structure in accordance with the present invention.
Figure 4:
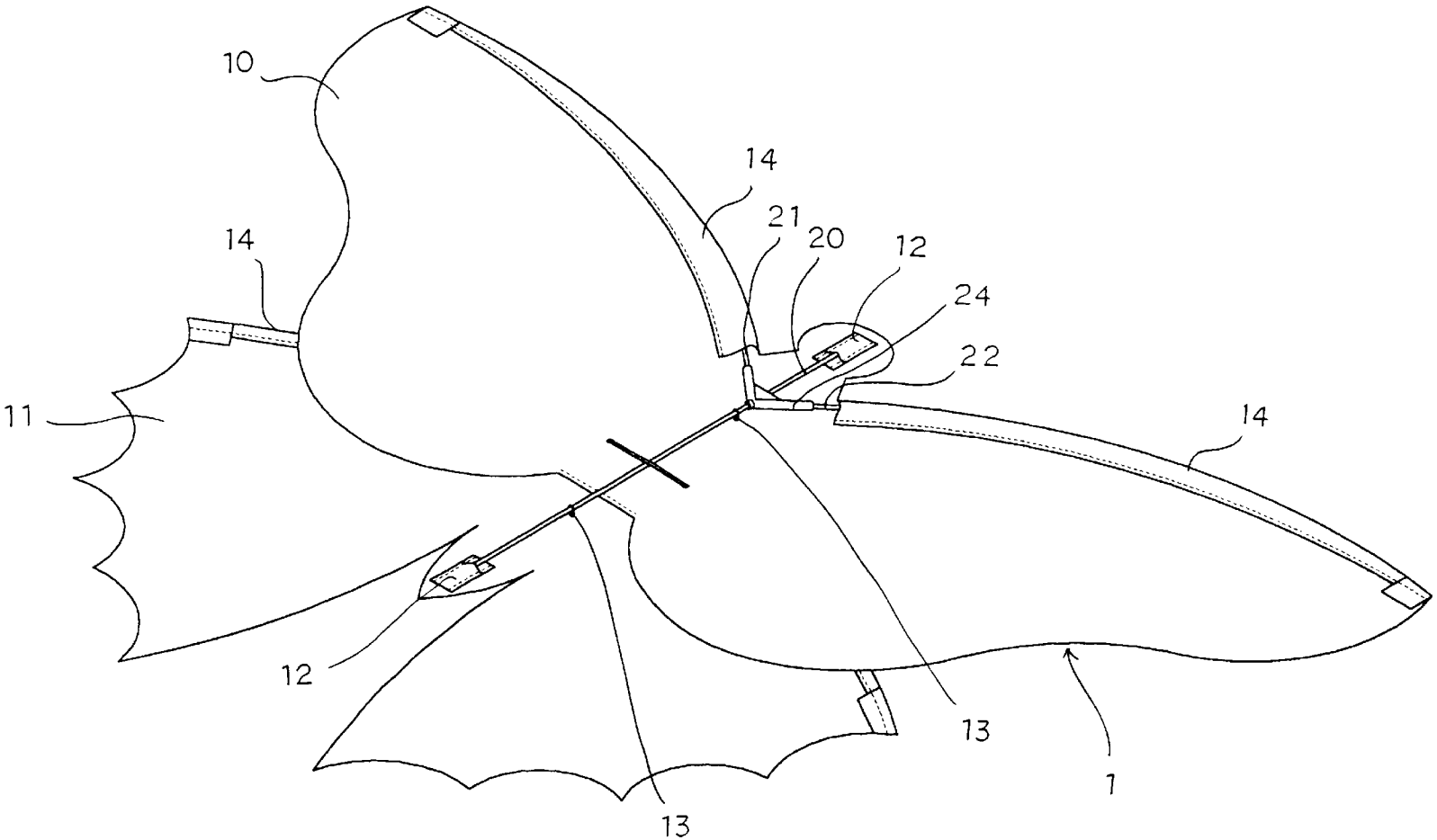
FIG. 4 is a perspective assembly view of the kite structure as shown in FIG. 3.
Figure 5:
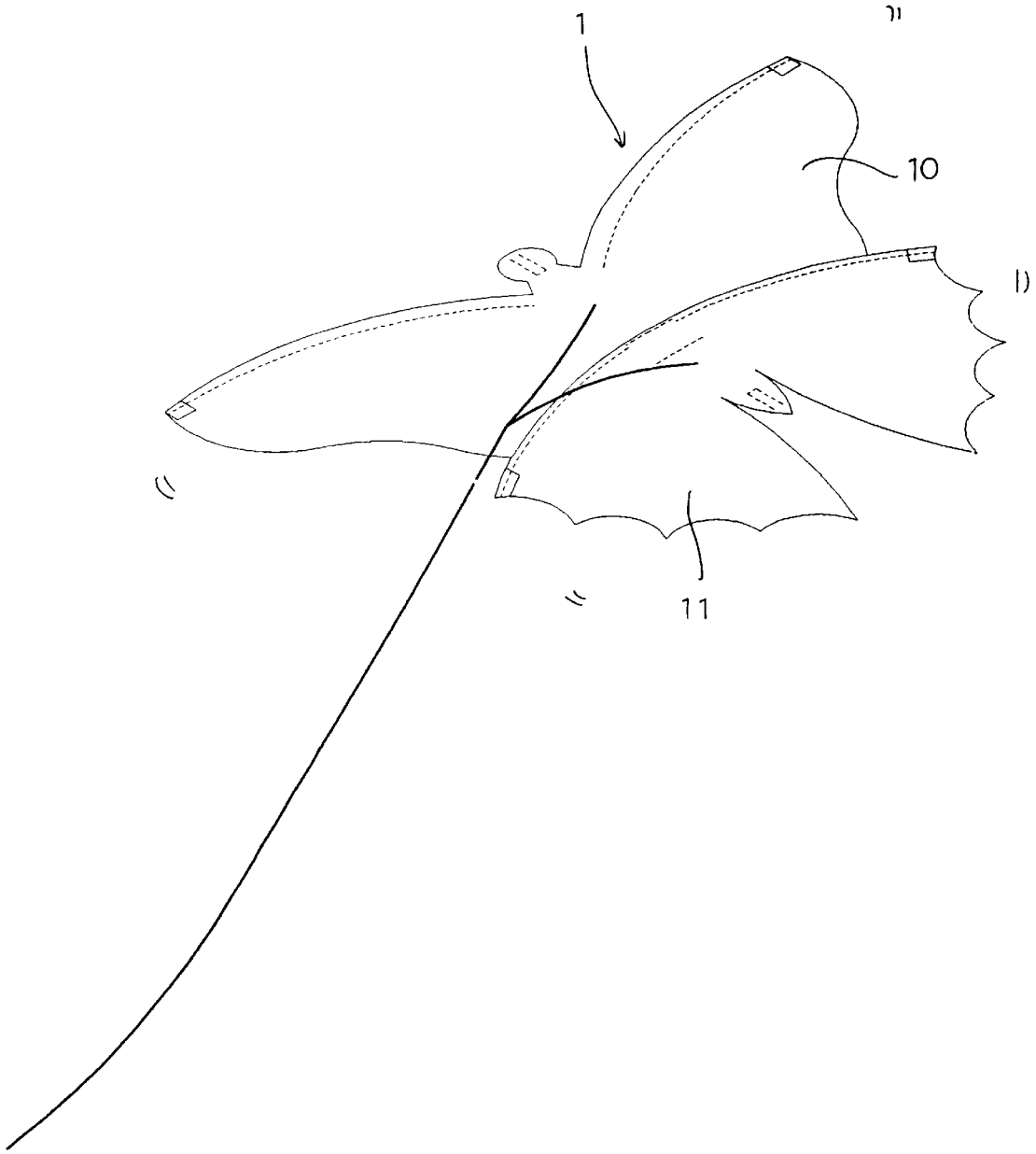
FIG. 5 is a schematic view of the kite structure as shown in FIG. 4.

Referring to the drawings and initially to FIGS. 3–6, a kite structure in accordance with the present invention comprises a body 1, and a skeleton 2.

The body 1 is a two-piece type of cloth material and includes an upper piece 10 and a lower piece 11 integrally stitched on the upper piece 10 in a locally overlapping manner. Preferably, the body 1 consisting of the upper piece 10 and the lower piece 11 has the shape of an animal, and insect or the like. Each of the upper piece 10 and the lower piece 11 has a central portion provided with a positioning base 12 and a plurality of retaining rings 13. Each of the upper piece 10 and the lower piece 11 having a front edge provided with curved tubular collars 14.

The skeleton 2 includes a central main bar 20 extending through the retaining rings 13 and having two ends each secured in the positioning base 12, a manifold connector 24 secured on the central main bar 20, a left support bar 21 extending through a first one of the curved tubular collars 14 of the upper piece 10 and having a distal end secured in a first side of the manifold connector 24, a right support bar 22 extending through a second one of the curved tubular collars 14 of the upper piece 10 and having a distal end secured in a second side of the manifold connector 24, and a lower support bar 23 extending through the curved tubular collar 14 of the lower piece 11 and secured therein. The upper piece 10 of the body 1 is separated into a right portion and a left portion by the central main bar 20.

The curved tubular collars 14 of the upper piece 10 of the body 1 are separated from each other in a symmetrical manner, and the curved tubular collar 14 of the lower piece 11 of the body 1 has a center defining a breach for facilitating insertion of the lower support bar 23 of the skeleton 2.

Each of the upper piece 10 and the lower piece 11 has a rear edge which is flexible without support so that each of the upper piece 10 and the lower piece 11 has a solid front edge which contains the skeleton 2 therein, and a soft rear edge without the skeleton 2.

Figure 6:
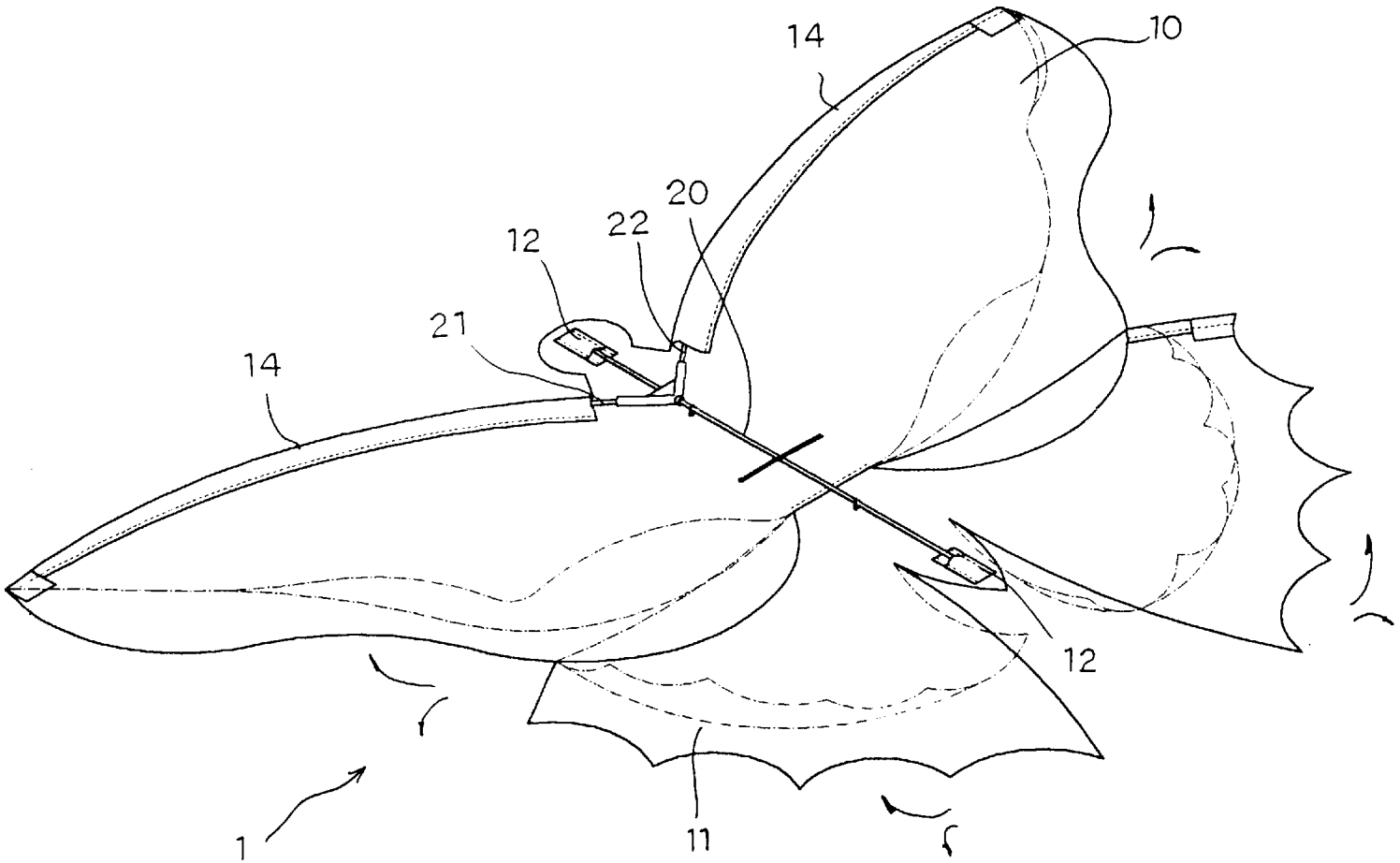
FIG. 6 is an operational view of the kite structure as shown in FIG. 4.

In such a manner, each of the upper piece 10 and the lower piece 11 has a solid front portion and a soft rear portion. As shown in FIG. 6, the soft rear portion of each of the upper piece 10 and the lower piece 11 swings freely and arbitrarily by the wind power and the wind direction to facilitate passage of the air current, thereby preventing the kite structure from stalling due to the subjected force problem.

Accordingly, the kite structure in accordance with the present invention has the following advantages.

1. The body 1 is made of a two-piece cloth consisting of an upper piece 10 and a lower piece 11 while the skeleton 2 includes a central main bar 20, a left support bar 21, a right support bar 22, and a lower support bar 23 for supporting the body 1 so that each of the upper piece 10 and the lower piece 11 has a solid front portion which contains the skeleton 2 therein, and a soft rear portion without the skeleton 2 whereby the soft rear portion of each of the upper piece 10 and the lower piece 11 swings freely and arbitrarily, thereby achieving the balance of flight, and thereby enhancing the active aesthetic quality of the kite structure.
2. The balance effect of the kite structure is achieved by the swinging action of the soft rear portion of each of the upper piece 10 and the lower piece 11 without having to additionally provide tail straps as are provided in the conventional kite.
3. The central main bar 20, the left support bar 21, the right support bar 22, and the lower support bar 23 of the skeleton 2 are detachable from the body 1, thereby facilitating the user carrying and storing the kite structure.

It should be clear to those skilled in the art that further embodiments may be made without departing from the scope of the present invention.

What is claimed is:

1. A kite structure comprising:

a body (1) including an upper piece (10) and a lower piece (11) stitched on said upper piece (10) in a locally overlapping manner, each of said upper piece (10) and said lower piece (11) having a central portion provided with a positioning base (12) and a plurality of retaining rings (13), each of said upper piece (10) and said lower piece (11) having a front edge provided with curved tubular collars (14); and a skeleton (2) including:

a central main bar (20) extending through said retaining rings (13) and having two ends each secured in said positioning base (12);

a manifold connector (24) secured on said central main bar (20);

a left support bar (21) extending through a first one of said curved tubular collars (14) of said upper piece (10) and having a distal end secured in a first side of said manifold connector (24);

a right support bar (22) extending through a second one of said curved tubular collars (14) of said upper piece (10) and having a distal end secured in a second side of said manifold connector (24); and a lower support bar (23) extending through said curved tubular collar (14) of said lower piece (11) and secured therein.

2. The kite structure in accordance with claim 1, wherein said curved tubular collars (14) of said upper piece (10) of said body (1) are separated from each other in a symmetrical manner, and said curved tubular collar (14) of said lower piece (11) of said body (1) has a center defining a breach for facilitating insertion of said lower support bar (23) of said skeleton (2).

3. The kite structure in accordance with claim 1, wherein each of said upper piece (10) and said lower piece (11) has a rear edge which is flexible without support so that each of said upper piece (10) and said lower piece (11) has a solid front edge which contains said skeleton (2) therein, and a soft rear edge without said skeleton (2).

4. The kite structure in accordance with claim 1, wherein said body (1) consisting of said upper piece (10) and said lower piece (11) has a shape of an animal.

5. The kite structure in accordance with claim 1, wherein said body (1) consisting of said upper piece (10) and said lower piece (11) has a shape of an insect.

* * * * *